United States Patent [19]

Pennington

[11] Patent Number: 4,802,423

[45] Date of Patent: Feb. 7, 1989

[54] COMBUSTION APPARATUS WITH AUXILIARY BURNING UNIT FOR LIQUID FLUIDS

[75] Inventor: Rodney L. Pennington, Morris Township, Morris County, N.J.

[73] Assignee: Regenerative Environmental Equipment Co. Inc., Morris Plains, N.J.

[21] Appl. No.: 127,158

[22] Filed: Dec. 1, 1987

[51] Int. Cl.[4] ..... F23B 7/00

[52] U.S. Cl. ..... 110/233; 110/211; 110/238; 431/5

[58] Field of Search ..... 110/238, 211, 204, 233; 431/5, 115, 116; 126/91 A

[56] References Cited

U.S. PATENT DOCUMENTS

| | | | |
|---|---|---|---|
| 3,319,692 | 5/1967 | Reba et al. | 431/116 |
| 3,353,528 | 11/1967 | Robinson | 126/91 A |
| 3,620,657 | 11/1971 | Robinson | 431/116 X |
| 4,697,531 | 10/1987 | Behedick | 116/211 X |

*Primary Examiner*—Edward G. Favors
*Attorney, Agent, or Firm*—Paul & Paul

[57] ABSTRACT

A combustion apparatus is provided, preferably of the thermal heat regeneration type, in which noxious or other gases are passed to an incineration chamber, to be burned at a sufficiently high temperature that they are disposed of. An auxiliary burning unit is provided, for handling liquid substances, such as fuels, that may be hazardous liquid wastes, such as toxic liquid wastes and the like that are combustible. These liquid wastes may be burned in the auxiliary unit, by exposure to a sufficiently high temperature for a sufficiently long time that they are rendered substantially pure, and they may then enter as gases into the gas incineration apparatus. The liquid substances being burned in the auxiliary unit preferably are brought to a high temperature by passing through an elongate portion of the unit, and then traveling in a reverse flow direction, back over a common wall that has been preheated by liquid being burned in the unit, for efficient heat utilization.

16 Claims, 2 Drawing Sheets

COMBUSTION APPARATUS WITH AUXILIARY BURNING UNIT FOR LIQUID FLUIDS

BACKGROUND OF THE INVENTION

In prior art devices, and particularly those of the energy regeneration type, it has been known to bring contaminated fumes or odors into a combustion chamber for burning the same at a sufficiently high temperature that substantially all that is released into the atmosphere is converted to carbon dioxide and water.

It has also been known that, in the passage of such gases into a combustion chamber, they can preferably and preliminarily pass through stoneware beds on their way to the combustion chamber, which stoneware beds have been pre-heated, so that they, in turn, can preheat the incoming gases so that combustion is assured as soon as the incoming gases pass into the combustion chamber. Sometime, such gases, if they contain volatile organic compounds, can auto-ignite while still in the presence of the stoneware in the stoneware chambers. Generally, however, the principal combustion takes place in the combustion chamber. Periodically, the flow of gases is reversed, such that gases from the combustion chamber pass outwardly through the stoneware chamber, to pre-heat the same, as the products of combustion pass outwardly on their way to atmosphere. Generally such combustion processes alternate the flow through the recovery chambers having stoneware therein, such that the stoneware alternately pre-heats the incoming gases containing the undesired volatile organic compounds, or is itself heated by outgoing gases passing from the combusion chamber to atmosphere. This alternation occurs on a regular basis.

An example of such a sysem is that which is disclosed in U.S. Pat. No. 3,895,918 issued to James H. Mueller on July 22, 1975, the complete disclosure of which is herein incorporated by reference.

In many of todays manufacturing processes, it is also known that certain substances, such as solvents contain hazardous or toxic chemicals, such as hydrocarbons, including polychlorinated biphenyls ( PCBs ), or other potentially hazardous and/or toxic substances, must be disposed of. When such substances are in liquid form, and are to be disposed of, they can present an environmental problem if the disposal is not done properly. In the past, it has been suggested to dispose of the same by burning them in an incineration apparatus of a type that is intended to burn contaminated fumes or odors, by delivering them into the combustion chambers of such apparatus, whereby exposure to open heat will burn them to destruction. However, such apparatus do not allow for a sufficient residence time of the hazardous and/or toxic liquids, to provide sufficient combustion to reduce such substances to an acceptable level of purity, for example, upwards of ninety-nine percent destruction of hydrocarbons or like substances.

SUMMARY OF THE INVENTION

The present invention is directed to an apparatus for use with a boiler, incinerator, or combustion chamber, that allows for pre-burning of such liquid substances at a sufficiently high temperature, for a sufficiently long time, under sufficient motion of the fluid being burned that it experiences turbulence, whereby the same may be destroyed.

At the same time, the present invention allows such burning of such liquid substances to provide an auxiliary fuel to the main combustion chamber, boiler, or the like.

Accordingly, it is a primary object of this invention to provide a novel combination of an auxiliary burner unit for a boiler, incinerator, or the like, for use therewith, and for separate attachment to existing such incinerators, boilers, or the like.

It is the further object of this invention to accomplish the above object, wherein the auxiliary burner unit is adapted to destroy hazardous and/or toxic liquid substances by burning the same at a sufficiently high temperature, for a sufficiently long period of time, during their flow through the unit, that an acceptable level of purity is obtained.

It is the further object of this invention to accomplish the above objects, wherein the hazardous/toxic substances that are being burned as liquids, provide an auxiliary fuel for fueling the combustion in a main incinerator, boiler, or the like.

It is still another object of this invention to accomplish each of the above objects, wherein the efficient use of heat in the auxiliary unit is efficiently controlled, by the use of a reverse flow path, or series of paths.

It is another object of this invention to accomplish the object set forth immediately above, wherein the auxiliary unit utilizes at least one elongate path that exists on opposite sides of a common wall with another elongate path to achieve the desired residence time while the burning of the liquid takes place, for a desired temperature, under desirable conditions of turbulence.

Other objects and advantages of the present invention will be readily apparent from a reading of the following brief descriptions of the drawing figures, the detailed descriptions of the prefered embodiment, and the appended claims.

BRIEF DESCRIPTIONS OF THE DRAWING FIGURES

DETAILED DESCRIPTION OF THE PREFERRED EMBODIMENT

Figure 1:
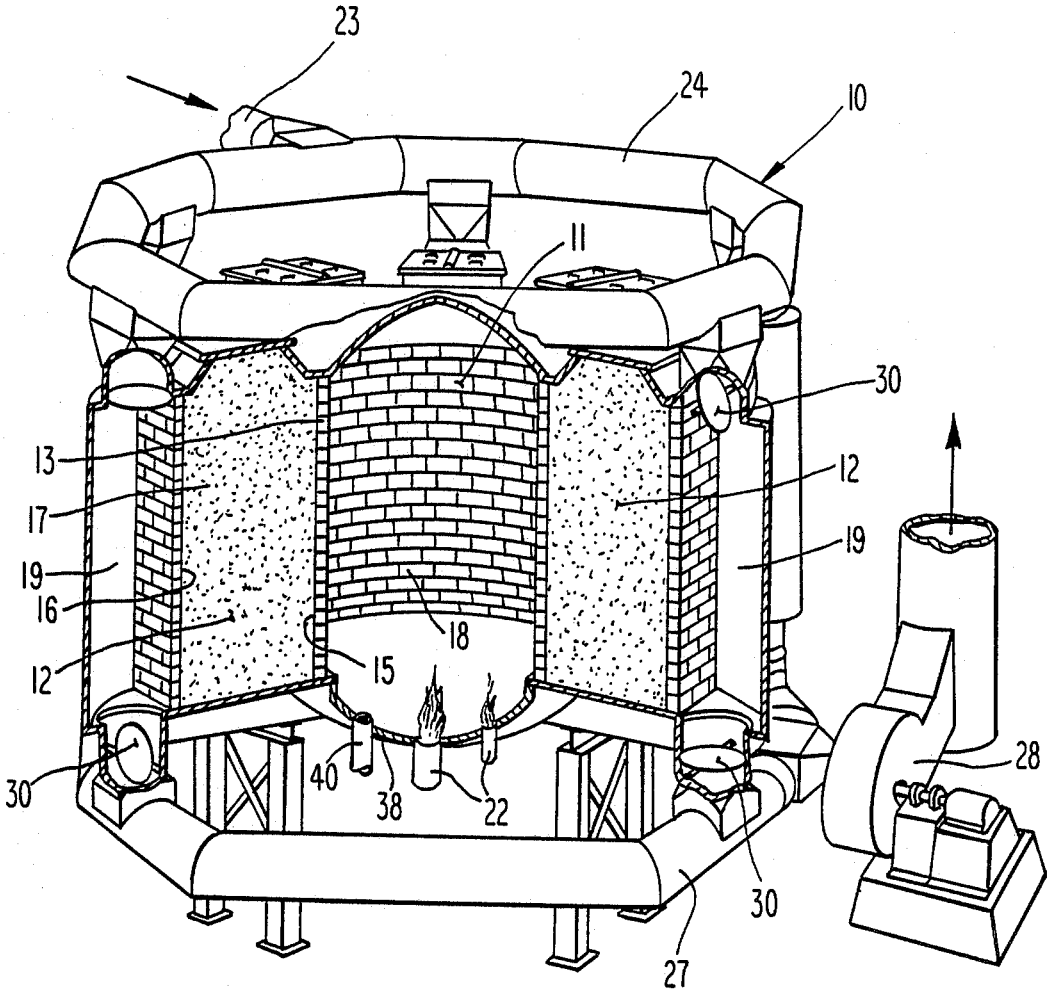
FIG. 1 is a schematic perspective view, partially broken away, of an incineration apparatus having an auxiliary burner unit, in accordance with the present invention.
Figure 2:
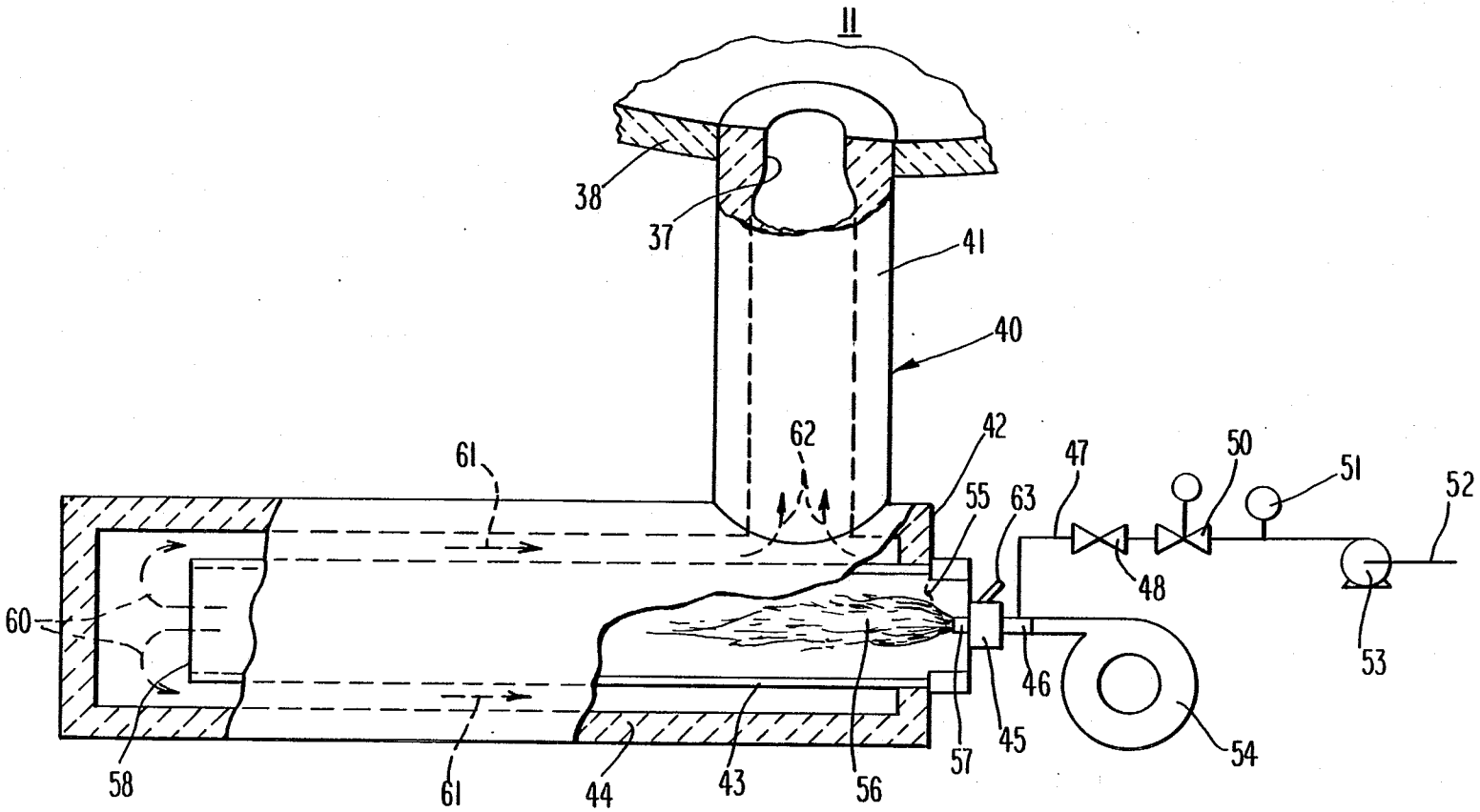
FIG. 2 is an enlarged view of the auxiliary burner unit, fragmentally illustrated, attached to the incineration apparatus, and with portions of the auxiliary burner being illustrated in vertical section, for the sake of clarity, and with portions of the illustration being schematic.

Referring now to the drawings in detail, reference is first made to FIG. 1, wherein an incineration apparatus is generally designated by the number 10, as comprising a high temperature combustion chamber 11 having a plurality of energy recovery chambers 12 disposed thereabout, separated therefrom by a wall 13. The wall 13 is shown in FIGS. 1 and 2 to have convex sides or faces 15 and concave sides or faces 16. The stoneware 17 within the chambers 12 exert forces of weight or gravity against the convex faces 15 of the wall 13 that keep the individual blocks 18 under compression. The blocks 18 have perforations (not shown) in them for passage of gases therethrough from the concave faces 16 to convex faces 15, and the reverse, as will be explained hereinafter, and are generally constructed of refractory material, laid in generally horizontal rows, with each row comprising a plurality of blocks, and with adjacent rows being in staggered relation to each other.

The combustion chamber 11 has one or more burners 22 therein, coming up through the bottom, as illustrated in FIG. 1. Such burners enable the combustion within the combustion chambers to take place at temperatures up to 2000° F., or more, depending upon the ingredients of the gases.

Generally, the incoming gases from a suitable factory, plant or the like enter the inlet 23, into the inlet toroid distribution facility 24, by which they may enter via vertical ducts 19, certain ones of the already-preheated energy recovery chambers 12, to pass over the pre-heated stones that are piled up therein, so that when such gases enter the combustion chamber by passing through the porous wall portions 14 thereof, into the combustion chamber 11, they may readily be burned therein, with the gases then passing outwardly through other porous wall portions 13, passing through still other stoneware beds in recovery chambers 12, to serve to heat the stoneware within such chambers as they pass outwardly therethrough, on their way to a discharge duct 27, to be discharged via pump-operated duct 28, as shown, to atmosphere, preferably in the form of carbon dioxide and moisture.

It will be seen that various valving arrangements 30 may be used to direct the flow of gases either inwardly through the recovery chambers on their way to combustion chamber 11, or outwardly from the combustion chamber 11, through the recovery chamber 12, as desired, but that, in any given apparatus 10, some of the recovery chambers 12, will, at any given time, be passing gases inwardly, and some will be passing gases outwardly, as will be understood from the prior art discussed above.

Preferably, the blocks 18 that make up the wall portions 13 are porous in the sense that they have perforations through them, which perforations amount to about 30%–40% of the volume of each said block, and in some cases, about 50% to 70% of each block.

As constructed, and in accordance with this invention, the apparatus will work such that contaminated fumes or odors may enter the apparatus through the inlet manifold-like ring 24. The valves 30 thus direct such gases containing fumes or the like, into the chambers 12, passing over the stoneware, and moving them toward the incineration chamber. They leave the stoneware beds 12 at temperatures very close to the incineration temperature. Oxidation is completed in the combustion chamber 11, by means of a gas (or oil) burner that maintains a pre-set incineration temperature.

The gases may contain volatile organic compounds that can auto-ignite, while still in the stoneware, and if they do, such will further reduce the auxiliary fuel requirement provided by the burners 22. In some situations, the incoming gases entering the duct 23 may contain enough volatile organic compounds that the energy released can provide all of the heat required for the apparatus and the burner may automatically go to pilot. After the burning is effected in the chamber 11, the purified gases are then pulled from such chamber 11 through the stoneware beds which are at that time in an "outlet" mode, thereby passing heat to the stoneware, which the stoneware absorbs.

It will be understood that the situation is then reversed, such that a given stoneware bed alternately operates to receive heat from outgoing gases, or to pre-heat incoming gases, depending upon the settings of the valve 30.

In accordance with the present invention, gases may be treated from spray booths, for example, at an exhaust volume of 150,000 SCFM; agricultural pesticides may be disposed of at high rates of energy recovery; wide ranges of solvents from coating and laminating may be disposed of with a high percentage of thermal energy recovery; emissions from coatings of paper and film may be taken care of at high rates of energy recovery; hydrocarbons and ceramic kiln emissions may be disposed of at high rates of thermal engergy recovery; and emissions from various chemical manufacturing processes may be disposed of, again at high rates of thermal energy recovery, as well as many other prospects of treatment in accordance with the present invention.

In accordance with the improvement provided by the present invention, there is provided, attached to the bottom of the chamber 11 as illustrated in FIG. 1, an auxiliary burner unit 40, for burning the above-mentioned hazardous and/or toxic liquid contaminates, for use as an auxiliary fuel for the chamber 11, and to destroy those contaminates to an acceptable level of destruction.

With reference now to FIG. 2, the liquid solvent burning unit 40 is more clearly illustrated, connected to deliver the gaseous products of combustion of liquid solvents up through the bottom wall 38 of the combustion chamber, to the interior 11 of the combustion chamber.

The unit 40 as illustrated in FIG. 2 shows a generally vertical portion 41 of a refractory lined combustion chamber, that is necked down or narrowed or restricted as shown at 37 for increased vertical velocity, for better turbulence and mixing as gaseous products of liquid solvent combustion enter the chamber 11. Disposed below the vertical chamber portion 41 is a generally horizontally directed portion 42, that comprises essentially an inner tubular member 43 and an outer tubular or housing member 44. The inner tubular member will generally be a high temperature cylinder or tube, preferably but not necessarily ceramic in construction, and the outer tubular member 44 may be of similar construction, but will generally be refractory lined. The horizontal portion 42 may vary in length, but could be from 14 feet to 20 feet in length, and also comprises a refractory lined combustion chamber. At the right-most end of the tubular member 43, there is a flame-emanating burner 45, to which is delivered the combustible hazardous and/or toxic liquid wastes that can operate as fuel, through a suitable inlet 46 that may, if desired be of the carburetor type, via line 47, valves 48 and 50, and a pressure gauge 51, with such solvent being delivered from line 52 via solvent pump 53. Also present but not illustrated in line, may be suitable filters, controls, etc., not shown, such as may be employed with any conventional fuel train. Also connected to the inlet member 46 is a blower 54, that may be provided either separately (not shown) or as part of the blower 54, suitable filters, etc., for blowing air together with fuel into the burner inlet 45. Once the air and fuel enters the interior 55 of the tubular member 43, it is burned by flame 56 emanating from the nozzle 57, to define a first elongate path for the fuel, down through the end 58 of member 43, then around the tubular wall of member 43, as indicated by the arrows 60, to then pass rightwardly between the tubular members 43 and 44, in the direction of the arrows 61, passing by already heated common shared wall of the tubular member 43, to reinforce the heating effect thereof, with such gases then being delivered upwardly into vertical unit portion 41 in the direction of arrows 62.

The leftward first path and rightward second path (i.e., through the tubular member 43, and then around the tubular member 43 but inside the tubular member 44), together, define an aggregate flow path that is sufficiently long to allow for maintaining a sufficiently high temperature to burn such hazardous/toxic materials such as PCBs, which will amount to a travel path that is sufficient to maintain in excess of 2000° F. for at least about 2 seconds, such as may yield an acceptable level of purity for gases entering the chamber 11 of 99.99% pure, and more preferably, a temperature above 2200° F., for at least about 2 seconds, and most preferably, a temperature within the range of about 2200° F. to about 2500° F., for at least about 2 seconds, and in some instances it may be desirable that the temperature reach 3000° F., all for increased purity.

It is thus seen that the unit 40 provides, preferably by means of a reverse flow as aforesaid, the ability to burn liquid solvents to remain heated to the desired temperature for a desired predetermined period of time, while undergoing the necessary turbulence that permits mixing, to destroy the contaminates.

It will further be appreciated that the products of such combustion within the unit 40 becomes a fuel for the chamber 11, which may function as an auxiliary fuel therefore. It will also be apparent that the reverse flow may take on other configurations, but will preferably always involve a reverse flow about a common shared wall, for using a wall of some sort that has been preheated by earlier flow across its other surface.

The products of combustion from the unit 41 may enter the chamber 11 at a flow volume of 500 feet per minute, and at a velocity, i.e., of 2000 feet per minute as they pass through the choke or restriction 41.

It will also be apparent that, if desired, a flame safe guard unit 63 may be employed for visual observation of the absence or presence of fire 56 inside the unit, from outside the unit, if desired.

It will be appreciated that in accordance with the present invention, there is provided a zero-cost fuel source 40 for the chamber 11, and the benefit of eliminating a cost of relocating or otherwise disposing of spent liquid solvents, as well as providing an efficient system that both produces an auxiliary fuel for the principal combustion chamber 11, as well as disposing of otherwise undesirable components such as hazardous and/or toxic materials.

It will be apparent that the delivery line 47 for solvent may optionally be provided with distillation equipment, for distillation of solids therefrom, if desired, with appropriate filter equipment, in the event that distillation is not desired, other equipment may be provided for filtering solids therefrom, with suitable holding tanks, additional pumps, etc., as well as, safety controls, all as may be desired.

It will also be apparent from the foregoing that various modifications may be made in the details of construction, as well as in the use and operation of the apparatus of the present invention all within the spirit and scope of the invention as defined in the appended claims.

What is claimed is:

1. A combustion apparatus for incinerating gaseous fluids, comprising a combustion chamber, means for delivering gases to be burned into the combustion chamber and for withdrawing the gaseous products of combustion therefrom, and means for burning the gases thus delivered while in the chamber, the improvement comprising an auxiliary burning unit for burning combustible waste liquid as a fuel and for delivery of hot gases resultant therefrom into the combustion chamber, said unit including:

(a) a burning chamber;

(b) means for delivering liquid fuel and air to the burning chamber of the unit for ignition of liquid fuel and for providing a desired burning temperature in the burning chamber;

(c) with said burning chamber including means defining first and second elongate paths of travel for products of combustion; and (d) said first and second elongated paths being at least in part on opposite sides of a common shared wall.

2. A combustion apparatus for incinerating gaseous fluids, comprising a combustion chamber, means for delivering gases to be burned into the combustion chamber and for withdrawing the gaseous products of combustion therefrom, and means for burning the gases thus delivered whilein the chamber, the improvement comprising an auxiliary burning unit for destruction of combustible hazardous liquid wastes and for delivery of hot gases resultant therefrom into the combustion chamber, said unit including:

(a) a burning chamber;

(b) means for delivering liquid fuel and air to the burning chamber of the unit for ignition of liquid fuel and for providing a desired burning temperature in the burnng chamber;

(c) with said burning chamber including means defining first and second elongate paths of travel for products of combustion; and (d) said first and second elongated paths being at least in part on opposite sides of a common shared wall.

3. A combustion apparatus adapted for use with an incinerator, boiler or the like, having a burning chamber, and comprising an auxiliary burning unit, said unit including:

(a) a burning chamber;

(b) means for delivering liquid fuel and air to the burning chamber of the unit for ignition of liquid fuel for providing a desired burning temperature in the burning chamber;

(c) with said burning chamber including means defining the first and second elongate paths of travel for products to combustion;

(d) said first and second elongate paths being at least in part on opposite sides of a shared common wall; and (e) wherein said burning chamber and means for delivering and providing includes a flow path means sufficiently long and means for producing sufficiently high temperature, to maintain a temperature in excess of 2,000° F. for at least about two seconds.

4. The apparatus of any one of claims 1 or 2, wherein said burning chamber and the means for delivering and providing includes a flow path means sufficiently long and means for producing a sufficiently high combustion temperature, to maintain a temperature in the unit in excess of 2000° F. for at least about 2 seconds.

5. The apparatus of any one of claims 1, 2 or 3 wherein said burning chamber and the means for delivering and providing includes a flow path means sufficiently long and means for producing a sufficiently high combustion temperature, to maintain a temperature in the unit of at least about 2200° F. for at least about two seconds.

6. The apparatus of any one of claims 1, 2 or 3 wherein said burning chamber and the means for delivering and providing includes a flow path means sufficiently long and means for producing a sufficiently high combustion temperature, to maintain a temperature in the unit within the range of about 2200° F. to about 2500° F. for at least about 2 seconds.

7. The apparatus of any one of claims 1 or 2 wherein said elongate path comprises a first tubular member of high temperature durability and whereas the second elongate path comprises a second tubular member of high temperature durability disposed around said first tubular member.

8. The apparatus of claim 7, wherein said burning chamber and the means for delivering and providing includes a flow path means sufficiently long and means for producing a sufficiently high combustion temperature, to maintain a temperature in the unit in excess of 2000° F. for at least about 2 seconds.

9. The apparatus of claim 7, wherein the same means providing the desired burning temperature is engaged with an end of said first tubular member for ignition of fuel therein.

10. The apparatus of claim 9, wherein said burning chamber and the means for delivering and providing includes a flow path means sufficiently long and means for producing a sufficiently high combustion temperature, to maintain a temperature in the unit in excess of 2000° F. for at least about 2 seconds.

11. The apparatus of claim 2, wherein said burning chamber and the means for delivering and providing includes a flow path means sufficiently long and means producing a sufficiently high combustion temperature, to maintain a temperature in the unit for a sufficient amount of time to destroy the hazardous liquid waste by combustion.

12. The apparatus of any one of claims 1 or 2 wherein said means for delivering include liquid fuel pumping apparatus and air blower means.

13. A combustion apparatus for incinerating gaseous fluids, comprising a combustion chamber, means for delivering gases to be burned into the combustion chamber and for withdrawing the gaseous products of combustion therefrom, and means for burning the gases thus delivered while in the chamber, the improvement comprising an auxiliary burning unit for burning combustible waste liquid as a fuel and for delivery of hot gases resultant therefrom into the combustion chamber, said unit including:

(a) a burning chamber;

(b) means for delivering liquid fuel and air to the burning chamber of the unit for ignition of liquid fuel and for providing a desired burning temperature in the burning chamber;

(c) with said burning chamber including means defining first and second elongate paths of travel for products of combustion; and (d) said unit comprising also means for destruction of combustible hazardous wastes and for delivery of hot gases resulting therefrom into the combustion chamber.

14. The apparatus of claim 13, wherein said burning chamber and the means for delivering and providing includes a flow path means sufficiently long and means for providing a sufficiently high combustion temperature, to maintain a temperature in the unit in excess of 2000° F. for at least about 2 seconds.

15. The apparatus of claim 14, with said first and second elongate paths being at least in part on opposite sides of a common shared wall.

16. The apparatus of claim 15, wherein said elongate path comprises a first tubular member of high temperature durability and wherein the second elongate path comprises a second tubular member of high temperature durability disposed around said first tubular member.

* * * * *